US005566543A

United States Patent [19]

Taylor et al.

[11] Patent Number: 5,566,543

[45] Date of Patent: Oct. 22, 1996

[54] PVC-BASED GAS GENERANT FOR HYBRID GAS GENERATORS

[75] Inventors: Robert D. Taylor, Hyrum; Brett Hussey, Bountiful, both of Utah

[73] Assignee: Morton International, Inc., Chicago, Ill.

[21] Appl. No.: 153,686

[22] Filed: Nov. 17, 1993

[51] Int. Cl.[6] ..... C06D 5/06

[52] U.S. Cl. ..... 60/219; 60/205; 149/19.91; 149/83; 149/85

[58] Field of Search ..... 149/19.91, 61, 149/70, 83, 85, 35, 3; 60/219, 205

[56] References Cited

U.S. PATENT DOCUMENTS

| | | | |
|---|---|---|---|
| 3,155,749 | 11/1964 | Rossen et al. | 264/3 |
| 3,723,205 | 3/1973 | Scheffee | 149/19 |
| 3,762,972 | 10/1973 | Allen | 149/109 |
| 4,214,438 | 7/1980 | Hamilton et al. | 60/205 |
| 4,368,979 | 6/1993 | Jackson, Jr. | 149/21 |
| 4,369,079 | 1/1983 | Shaw | 149/2 |
| 4,806,180 | 2/1989 | Goetz et al. | 149/05 |
| 4,981,534 | 1/1991 | Scheffe | 149/19.91 |
| 5,034,070 | 7/1991 | Goetz et al. | 149/3 |
| 5,104,466 | 4/1992 | Allard et al. | 149/21 |
| 5,236,526 | 8/1993 | Perotto | 149/17 |
| 5,387,296 | 2/1995 | Taylor et al. | 149/35 |

OTHER PUBLICATIONS

European Patent Office, European Search Report, 14 Mar. 1995, 3 pages.

*Primary Examiner*—Charles T. Jordan
*Assistant Examiner*—John R. Hardee
*Attorney, Agent, or Firm*—Robert M. Didrick; Gerald K. White

[57] ABSTRACT

The amount of particulate matter that is forced into the passenger compartment of an automobile by the deployment of an air bag as it protects the lives of occupants is reduced by improving the filterability of the combustion products of a composition for generating gas to inflate the bag. The filterability is improved by adding a nucleating agent for alkali metal halide vapors formed during said combustion. Silica, alumina, and graphite are representative of the nucleating agents.

5 Claims, No Drawings

PVC-BASED GAS GENERANT FOR HYBRID GAS GENERATORS

BACKGROUND OF THE INVENTION

This invention relates to improved filterability of the combustion products of a gas generating composition comprised of polyvinyl chloride and inorganic oxidizer salts. More particularly, it relates to a gas generating composition for use in the inflation of devices such as air bags, escape chutes, and life rafts. It is particularly directed to a method for improving the filterability of such gases during the inflation of air bags used in passenger vehicles to restrain the movement of passengers in the event of a crash.

Inflation of such devices is generally accomplished by the controlled decomposition of sodium azide or other azo compounds which releases large volumes of nitrogen gas, and by the release of a gas such as air, nitrogen, carbon dioxide, helium, argon, and the like from pressure vessels. Hybrid gas generators combine the stored gas and high temperature combustion product gases from the burning of gas generating compositions. U.S. Pat. Nos. 3,155,749; 3,723,205; and 4,981,534 (which are incorporated herein by reference) describe formulations for gas generating compositions which are used primarily in hybrid systems. Said formulations comprise a vinyl chloride polymer as the binder and fuel, a plasticizer, an oxidizer, a hydrogen chloride scavenger, a stabilizer for the polymer, a catalyst, and coolants. The hydrogen chloride scavenger is a halogen-free alkali metal salt. The alkali metal chlorides formed by the scavenging are extremely difficult to filter out of the combustion product gas before it enters the deploying air bag. At the combustion temperature of these compositions (on the order of 2800° K. or about 2500° C. and about 4600° F.), the chlorides are all in the vapor phase. This fact essentially means that the filtration of such chlorides from the gas depends on the condensation of the vapors on the cold metal surfaces of the gas generator device.

SUMMARY OF THE INVENTION

An object of this invention, therefore, is to provide a polyvinyl chloride/inorganic oxidizer-based gas generating composition for inflatable devices which intrinsically causes an increase of the amount of filterable solid products of the combustion as compared with that of the prior art.

A related object of the invention is to provide nucleation sites within the gas generated by the composition for vaporized, normally solid products of the combustion of the composition.

A further related object of the invention is to provide a method for improving the filterability of combustion products of a polyvinyl chloride/inorganic oxidizer-based gas generating composition for inflatable devices such as air bags in automobiles.

The ultimate object of this invention is to reduce the amount of particulate matter that is forced into the passenger compartment of an automobile by the deployment of an air bag as it protects the lives of occupants in said automobile during a crash.

These and other objects which will become apparent from the following description of the invention are achieved by a method for improving the filterability of combustion products of a gas generating composition for an inflatable device, said composition containing a vinyl chloride polymer and/or a chlorinated polyethylene and an alkali metal oxidizing agent, said method comprising adding from about 0.1 to about 4 per cent of a nucleating agent for vaporous halides of alkali metals, said agent being selected from the group consisting of silica, alumina, aluminum silicates, graphite, aluminum, silicon, an alkaline earth metal salt, and mixtures thereof to the gas-generating composition; and causing said composition to burn in communication with a filter associated with said device. A gas generating composition particularly susceptible to the method comprises:

a vinyl chloride polymer and/or a chlorinated polyethylene;

a plasticizer;

from 0 to about 4 percent by weight of a bonding agent;

an inorganic oxidizer salt selected from the group consisting of chlorates, perchlorates, and nitrates of alkali metals and alkaline earth metals, and ammonium perchlorate, and mixtures thereof;

a halogen-free alkali metal salt reactive with available halogen to form an alkali metal halide;

said oxidizer salt being present in an amount at least sufficient to convert all available carbon to carbon dioxide and all available hydrogen to water;

said composition containing available combined alkali metal in an amount at least sufficient to convert all available halogen to alkali metal halide.

It is preferable to add from about 1 to about 2 percent, by weight of the total composition, of the nucleating agent. A fibrous silica, alumina, aluminum silicate, graphite or mixture thereof is preferred as the nucleating agent.

DETAILED DESCRIPTION OF THE INVENTION

The term vinyl chloride polymer, as employed herein, includes the homopolymer and copolymers containing up to about 10% by weight of one or more of a copolymerized component such as vinyl acetate and vinylidene chloride. Preferably, the vinyl chloride polymer is essentially fully polymerized and is employed in the form of plastisol-grade spheroidal particles. The chlorinated polyethylene has a molecular weight in the range of from 50,000 to 350,000 and has a chlorine content of about 56% by weight. When either of the chlorine containing polymers is used, the amount is from about 5 to about 15% by weight of the total composition, Any organic liquid plasticizer compatible with the vinyl chloride polymer and/or with the chlorinated polyethylene may be employed in amount ranging from about 5 to about 15% by weight of the total composition. Preferably, the plasticizer is of the type suitable for fluid plastisol formation and is exemplified by alkyl and alkoxyalkyl adipates, sebacates, azelates, and phthalates and more particularly by dibutyl, dioctyl, and di(3,5,5-trimethylhexyl) adipate, dibutyl and dioctyl sebacate, dibutyl, dioctyl, and dimethoxyethyl phthalate, glycol esters of higher fatty acids and the like. Such plasticizers are well known in the art. The plastisol-forming plasticizers are high boiling solvents for the polymers which form fluid suspensions therewith at low temperatures because of the limited solubility of the polymer at such temperatures but dissolve the polymer at high temperatures to form a solid gel.

The ratio of plasticizer to chlorine-containing polymer may be from 0.6;1 to 2:1. The preferred ratio of plasticizer to chlorinecontaining polymer is from 1.2:1 to 1.5:1 by weight for desirable physical properties, such as tensile strength and minimum cold flow, of the cured gas generating composition.

The amount of inorganic oxidizer salt may be in excess of the stoichiometric amounts expressed above and generally may be from about 60 to about 80% by weight of the total composition.

In like manner, the halogen-free alkali metal salts or scavenger salts may be employed in excess of the stoichiometric amounts and may generally be present in amounts ranging from about 1 to about 10% by weight but should not exceed available halogen by more than about 10 mole percent. This salt may also be an oxidizer as exemplified by sodium, potassium, and lithium nitrates and the corresponding nitrites. The non-oxidizing scavenger salts are exemplified by the alkali metal oxalates, carbonates, bicarbonates, particularly sodium oxalate, sodium carbonate, lithium carbonate, lithium oxalate, potassium carbonate, and potassium oxalate. Lithium carbonate is preferred because of the minimal amount of water that it absorbs from the air surrounding the inflatable device while standing in place in an auto over a number of years.

Grains of the gas generating composition are formed simply by heating it to the temperature at which the plasticizer dissolves the polymer, generally from about 160° to about 175° C., in an extruder, thence a die from which it exits as a shaped column, cooling the column and cutting it into grains of the desired length. The extrusion and forming process of U.S. Pat. No. 3,155,749 is satisfactory for making the grains of the gas generating composition described herein. As mentioned above, the polymer has only limited solubility in the plasticizer at low temperatures and gas generating compositions containing the polymer and plasticizer are usually described as "damp" meaning that it is only wetted by the plasticizer. It is preferable, therefore, to add a bonding agent to the basic gas generating composition in order to improve the mechanical properties thereof. Without the bonding agent, substantial de-wetting of the solid particles (i.e., of the oxidizer, hydrogen chloride scavenger, and nucleating agent) from the binder (i.e., the polymer) occurs upon the application of only minimal bending force to the grains formed as described above. This condition may lead to uncontrolled burning of the grains. For example, the high pressure impulse resulting from ignition of the grain may cause particle de-wetting with consequent loss of ballistic control within the inflatable device. The most serious consequence of this condition is over-pressurization of the containment structure within the device and explosion thereof. Therefore, it is preferable to add up to about 4% by weight of a bonding agent to the mixture of binder, plasticizer, oxidizer, scavenger, and nucleating agent before the extrusion and forming of the grains. Aziridines, such as those supplied by Minnesota Mining and Manufacturing (3M) as HX752 and HX868, an amine available from 3M under the trademark Tepanol, alkoxy titanates available from Kenrich Petrochemicals, Inc. and the corresponding zirconates, silicates, pyrophosphates, and phosphites are examples of the bonding agents contemplated for use in this invention.

In addition to the components described above, other additives may be incorporated into the gas generating composition of this invention. From 0 to about 2% by weight of a burning rate catalyst, exemplified by a transition metal oxide such as ferric oxide, may be added. PVC stabilizers which improve the overall aging characteristics of the composition as well as improving the heat stability of polyvinyl chloride during extrusion and other processing steps are preferably added, also. The amount of the stabilizer may be from about 0.001 to about 0.4% by weight of the total composition. Mixtures of calcium carbonate or other calcium salts, barium salts, and zinc mercaptoacid esters are well known in the PVC art as stabilizers. Molt teaches combinations of calcium carbonate and zinc mercaptoesters in U.S. Pat. No. 4,515,916. Organotin compounds and acetylenic diol compounds are also exemplary of the stabilizers contemplated. Examples of the organotin compounds include dialkyltin mercaptoalkyl carboxylates such as dibutyltin mercaptoethyl stearate and the sulfides thereof and dialkyltin- bis(alkylcarboxylates) or bis(alkyl thiocarboxylates) such as dimethyltin bis(isooctyl maleate) and its thioanalog. A preferred organotin mercaptoester, dimethyltin bis(2-ethylhexyl thioglycolate, is available from Morton International, Inc. under the trademark ADVASTAB® TM-181.

Lubricants such as lecithin, vegetable oil, paraffin waxes, polyethylene waxes, oxidized polyethylene waxes, stearyl stearate, glyceryl monostearate, calcium stearate, and the like substantially reduce the paste viscosity of the composition and consequently the torque associated with the extrusion of the composition. From 0 to about 4% by weight of a lubricant may be used in the composition of this invention. It is often convenient to combine the lubricant with the stabilizer as is done in Morton's ADVAPAK® LS-203 and SLS-1000.

The invention is further illustrated in more detail by the following examples in which all parts and percentages are by weight unless otherwise indicated. These non-limiting examples are illustrative of certain embodiments for the purpose of teaching those skilled in the art how to practice the invention.

EXAMPLE 1

A gas generating composition is formed into shaped grains by blending 7.0 parts of plastisol grade polyvinyl chloride with 8.76 parts of dioctyl adipate as the plasticizer, 74.37 parts of potassium perchlorate as the oxidizer, 7.51 parts of sodium oxalate as the hydrogen chloride scavenger, 2.0 parts of alumina as the nucleating agent, 0.3 part of a PVC stabilizer, and 0.05 part of ferric oxide as a burning catalyst in a conventional mixer and then heating and mixing the blend further by passing it through a heated extruder and a die, after which the shaped column is cooled and cut into the desired lengths.

EXAMPLES 2 and 3

The propellant chamber of an inflator similar to that described in U.S. Pat. No. 5,230,531 (incorporated herein by reference) was loaded with 24 grams of a composition similar to that of Example 1; a second was loaded with the same amount of the same composition except that the alumina was replaced by graphite as the slag-enhancing or nucleating agent; and a third was loaded with the same amount of a control composition having the same formulation except for the absence of a slag-enhancing agent. The exit ports of each inflator were fitted with an impingement point filter element comprising, from inside out, a 24 mesh stainless steel screen, a 24×10 stainless steel screen, a 3M Nextell AB22 element, a ceramic paper having a porosity expressed in terms of a gas flow of 30 cfm per square foot, and a 24 mesh stainless steel screen. The inflators were pressurized with argon gas to 3000 psi and connected to an air bag; each of the three resulting modules was placed in separate 100 cubic foot tanks. The inflator in each module was then fired to inflate the air bag to learn how much particulate matter was discharged from the inflator. Some part of the particulate material passed through the filter element into the air bag and thence into the tank by the firing of each composition. The total amount of particulate material was determined by withdrawing the particulate from the tank which had entered it from the air bag and passing it through an Andersen particle fractionating sampler. Respirable particulate is that whose size is 10 microns or less. The results are shown in the following table.

| | PARTICULATE ($mg/m^3$) | |
|---|---|---|
| EXAMPLE NO. | Total | Respirable |
| Control | 135 | 75 |
| 2 | 113 | 62 |
| 3 | 106 | 60 |

The subject matter claimed is:

1. A method for improving the filterability of combustion products of a gas generating composition for an inflatable device, said composition containing a vinyl chloride polymer and an alkali metal salt oxidizing agent, said method comprising adding from about 0.1 to about 4 per cent of a nucleating agent for vaporous halides of alkali metals, said agent being selected from the group consisting of silica, alumina, aluminum silicates, graphite, aluminum, silicon, an alkaline earth metal salt, and mixtures thereof to the gas-generating composition; and causing said composition to burn in communication with a filter associated with said device.

2. The method of claim 1 wherein the amount of the nucleating agent is from about 0.1 to about 2 per cent.

3. The method of claim 1 wherein the amount of the nucleating agent is from about 1 to about 2 per cent.

4. The method of claim 1 wherein the nucleating agent is fibrous.

5. The method of claim 4 wherein the amount of the nucleating agent is from about 0.1 to about 2 per cent.

* * * * *